US007802336B2

(12) United States Patent
Kim et al.

(10) Patent No.: US 7,802,336 B2
(45) Date of Patent: Sep. 28, 2010

(54) APPARATUS FOR CONTROLLING HOT WATER WASHING OF WASHING MACHINE AND METHOD THEREOF

(75) Inventors: Gon Kim, Jinhae-si (KR); Yu Beom Kang, Changwon-si (KR); Sang Man Je, Koje-si (KR)

(73) Assignee: LG Electronics Inc., Seoul (KR)

( * ) Notice: Subject to any disclaimer, the term of this patent is extended or adjusted under 35 U.S.C. 154(b) by 177 days.

(21) Appl. No.: 12/054,584

(22) Filed: Mar. 25, 2008

(65) Prior Publication Data

US 2008/0172803 A1 Jul. 24, 2008

Related U.S. Application Data

(62) Division of application No. 10/721,894, filed on Nov. 25, 2003, now abandoned.

(30) Foreign Application Priority Data

Nov. 28, 2002 (KR) ..... 10-2002-0075038

(51) Int. Cl.
*D06F 33/00* (2006.01)
*D06F 39/04* (2006.01)

(52) U.S. Cl. ..... 8/158

(58) Field of Classification Search ..... 8/158, 8/159; 68/12.02, 12.03, 12.05, 12.21, 12.22
See application file for complete search history.

(56) References Cited

U.S. PATENT DOCUMENTS

| | | | | |
|---|---|---|---|---|
| 4,703,633 | A | 11/1987 | Boscolo et al. | |
| 5,167,722 | A | 12/1992 | Pastryk et al. | |
| 5,394,582 | A | 3/1995 | Moon | |
| 5,449,884 | A * | 9/1995 | Lee | 219/497 |
| 6,044,510 | A * | 4/2000 | Cho | 8/158 |
| 6,553,594 | B2 | 4/2003 | Broker et al. | |
| 6,778,868 | B2 * | 8/2004 | Imamura et al. | 700/79 |
| 2003/0051296 | A1 | 3/2003 | Broker et al. | |

FOREIGN PATENT DOCUMENTS

| | | |
|---|---|---|
| KR | 10-0180479 | 12/1998 |
| KR | 10-2002-0057119 | 7/2002 |

* cited by examiner

*Primary Examiner*—Joseph L Perrin
(74) *Attorney, Agent, or Firm*—KED & Associates, LLP

(57) ABSTRACT

A system and method for controlling a hot water wash cycle in a washing machine is provided. The method includes supplying water to the washing machine, and determining a water level in the washing machine. When the water level reaches a heating water level at which a heating unit is submerged, the heating unit is turned on to heat the water while water continues to be supplied to the washing machine. When the water level reaches a washing water level and the water in the washing machine is at a washing water temperature, the heating unit is turned off and a wash cycle associated with a selected washing condition may be initiated. By turning on the heating unit as soon as it is submerged, wash time may be reduced.

6 Claims, 3 Drawing Sheets

APPARATUS FOR CONTROLLING HOT WATER WASHING OF WASHING MACHINE AND METHOD THEREOF

This application is a Divisional of U.S. patent application Ser. No. 10/721,894, filed Nov. 25, 2003 now abandoned. The entire disclosure of the prior application is considered as being part of the disclosure of the accompanying application and is hereby incorporated by reference therein. This application claims the benefit of Korean Application(s) No. 10-2002-0075038 filed on Nov. 28, 2002, which is/are hereby incorporated by reference.

BACKGROUND OF THE INVENTION

1. Field of the Invention

The present invention relates to a washing machine, and more particularly, to an apparatus for controlling a hot water washing of a washing machine and method thereof.

2. Discussion of the Related Art

Generally, a washing machine is equipped with a function of a hot water washing.

The hot water washing function is to perform washing using hot water to reduce a washing time and to wash a laundry more effectively.

The previous washing machine used to supply hot water via a separate hot water pipe for the hot water washing. Yet, the recent washing machine is equipped with a heater inside to heat water to enable the hot water washing using the heated water.

A method of controlling a hot water washing using a heater according to a related art is explained as follows.

Referring to FIG. 1, first of all, a user selects a hot water washing function from various functions of a washing machine (S1).

The user or washing machine sets up a hot water washing condition including a water level, a washing temperature, and the like according to a kind or amount of a laundry (S2).

Once the hot water washing condition is set up, the washing machine turns on a water supply valve to initiate water supply (S3).

Subsequently, the washing machine judges whether water is supplied to the setup water level or not (S4).

If the water is not supplied to the setup water level, the washing machine keeps supplying the water. If the water is supplied to the setup water level, the washing machine turns off the water supply valve to stop the water supply (S5).

The washing machine then actuates the heater to heat the supplied water (S6).

The washing machine judges whether a temperature of the water reaches the setup washing temperature (S7).

If the temperature of the water fails to reach the setup washing temperature, the washing machine keeps operating the heater. If the temperature of the water reaches the setup washing temperature, the washing machine stops operating the heater (S8).

The washing machine then executes the hot water washing using the hot water heated at the setup washing temperature (S9).

Finally, the washing machine stops operating or stands by for a next operation if the hot water washing is completed.

However, the related art method of controlling the hot water washing of the washing machine heats the supplied water after completion of the water supply, whereby a preparing time by the initiation of the hot water washing is too long.

This is because the hot water washing is initiated after the time by the completion of the water supply for the hot water washing and the time taken for heating the supplied water up to the setup washing temperature have passed.

Hence, the operating time of the washing machine for the hot water washing is prolonged, whereby the user experiences the inconvenience and waste of time as well as excessive electricity charges.

SUMMARY OF THE INVENTION

Accordingly, the present invention is directed to an apparatus for controlling a hot water washing of a washing machine and method thereof that substantially obviates one or more of the problems due to limitations and disadvantages of the related art.

An object of the present invention, which has been devised to solve the foregoing problem, lies in providing an apparatus for controlling a hot water washing of a washing machine and method thereof, by which a hot water washing time is reduced by reducing a time for taken to heat water.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided an apparatus for controlling a hot water washing of a washing machine including a water supply unit supplying water according to an inputted control signal, a heater unit heating the water up to a predetermined temperature according to the inputted control signal, a sensor unit sensing whether a water level of the water is a heating water level for heating or a washing water level for washing, the sensor unit sensing a temperature of the water, and a control unit controlling the water supply unit and the heater unit according to a sensing signal of the sensor unit.

In this case, the heating water level is a water level under which the heater unit is completely submerged, and the heating water level is 20~30% of the washing water level.

In another aspect of the present invention, there is provided, in a washing machine including a water supply unit supplying water, a heater unit heating the water, a sensor unit sensing a water level of the water, and a control unit controlling the water supply unit and the heater unit, a method of controlling a hot water washing of the washing machine including the steps of setting a washing condition for the hot water washing, supplying the water according to the set washing condition, judging whether the water level of the supplied water is a heating water level for heating the water, heating the water if the water level of the water is the heating water level, judging whether the water level of the supplied water is a washing water level according to the set washing condition, if the water level of the supplied water is the washing water level according to the set washing condition, judging whether a temperature of the water is a heating temperature according to the set washing condition, and if the temperature of the water is a heating temperature according to the set washing condition, executing the hot water washing.

In this case, the washing machine may be a drum type washing machine and the washing condition for the hot water washing may include the water level and the temperature of the water.

And, the method may further include the step of driving the water supply unit prior to the step of supplying the water, the step of driving the heater unit prior to the step of heating the water, the step of stopping driving the water supply unit prior to the step of judging whether the temperature of the water is the heating temperature according to the set washing condition, and the step of stopping driving the heater unit prior to the step of executing the hot water washing.

Moreover, in the step of judging whether the water level of the supplied water is the heating water level for heating the water, the heating water level is a water level under which the heater unit is completely submerged. And, the heating water level is preferably 20~30% of the washing water level.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
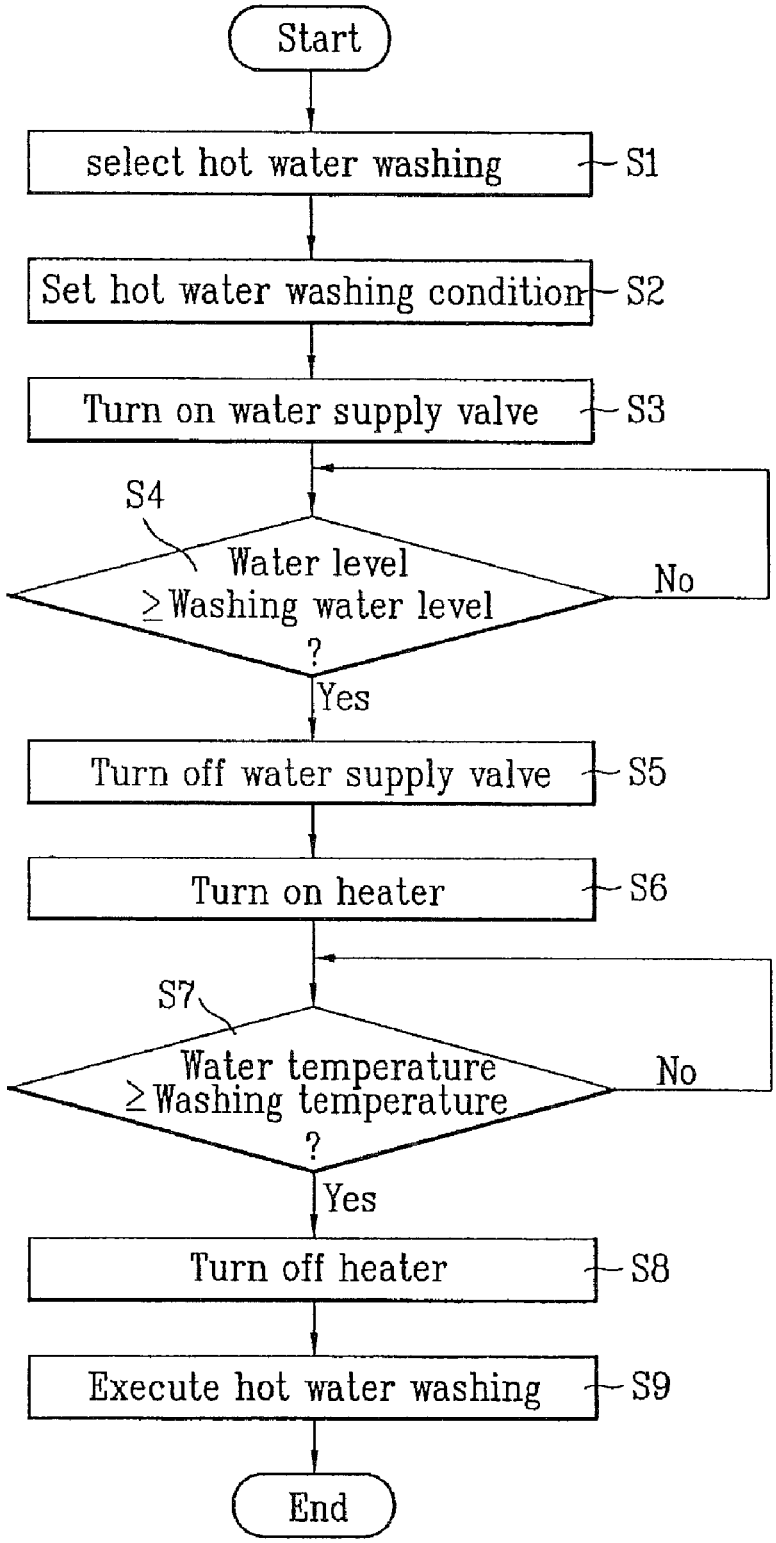
FIG. 1 Related Art
FIG. 1 is a flowchart of a method of controlling a hot water washing of a washing machine according to a related art.
Figure 2:
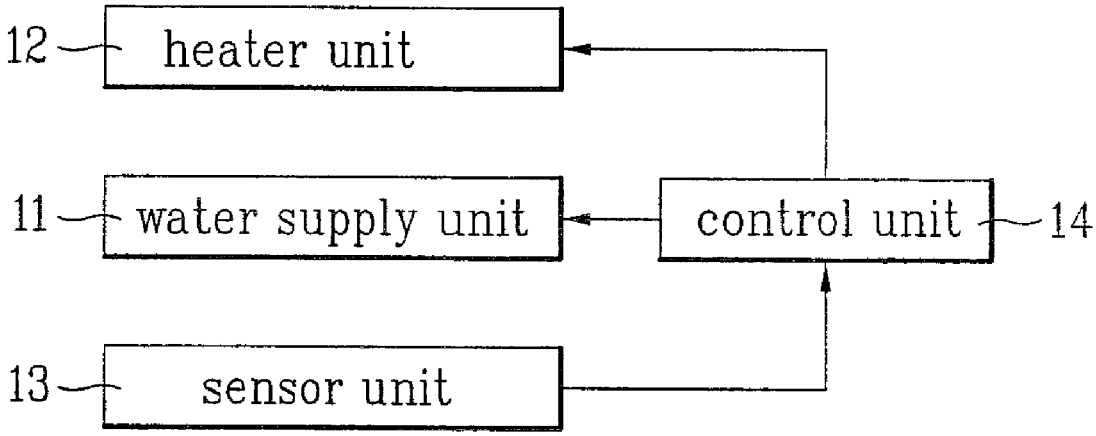
FIG. 2 is a block diagram of an apparatus for controlling a hot water washing of a washing machine according to the present invention.
Figure 3:
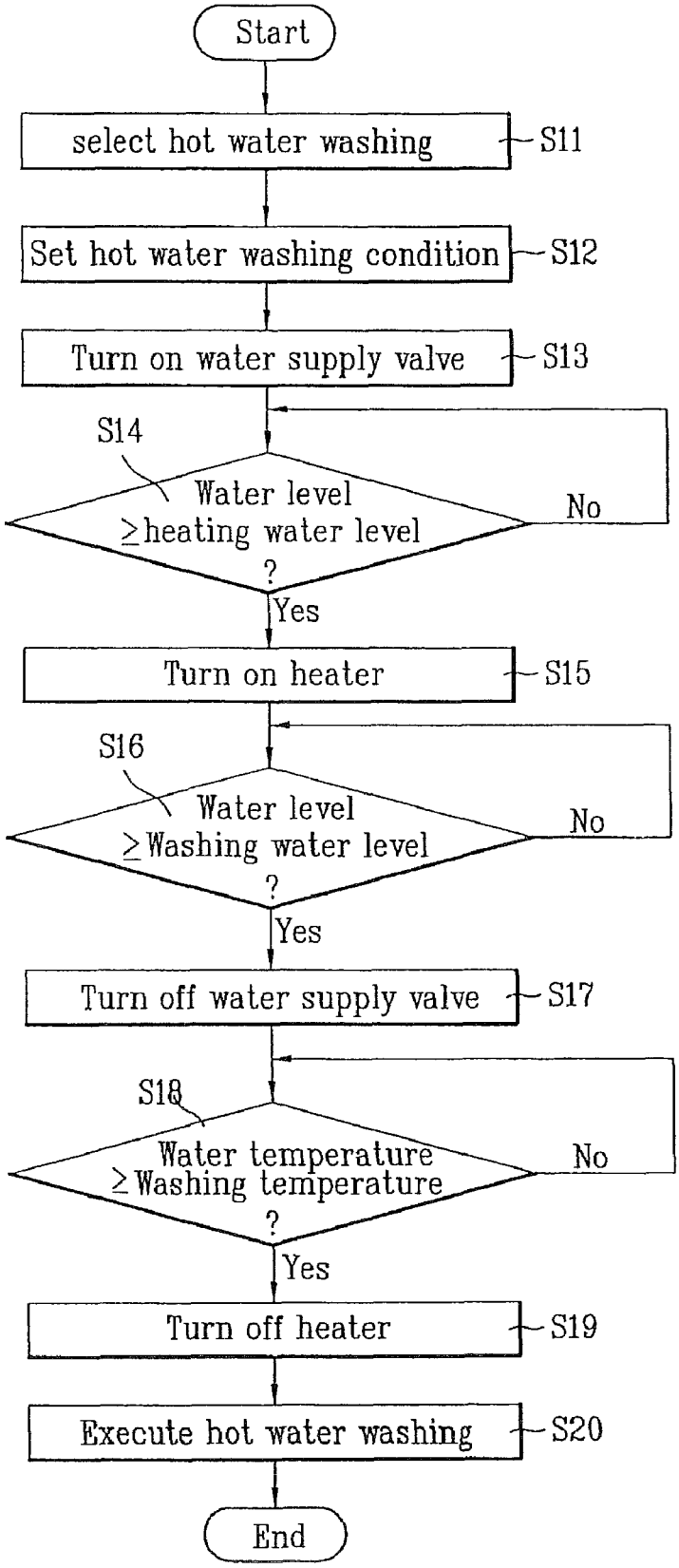
FIG. 3 is a flowchart of a method of controlling a hot water washing of a washing machine according to the present invention.

FIG. 2 is a block diagram of an apparatus for controlling a hot water washing of a washing machine according to the present invention, and FIG. 3 is a flowchart of a method of controlling a hot water washing of a washing machine according to the present invention.

Referring to FIG. 2, an apparatus for controlling a hot water washing of a washing machine according to the present invention includes a water supply unit 11, a heater unit 12, a sensor unit 13, and a control unit 14.

The water supply unit 11 supplies water to a washing tub according to a control signal inputted from the control unit 14, and the heater unit 12 heats the supplied water up to a predetermined temperature according to a control signal inputted from the control unit 14.

And, the sensor unit 13 senses whether a water level is a heating water level for heating or a washing water level for washing, and senses a temperature of the water to transfer to the control unit 14.

In this case, the heating water level is determined as a water level under which the heater 12 unit is completely submerged. The heating water level is preferably about 20~30% of the washing water level.

Moreover, the control unit 14 controls the water supply unit 11 and the heater unit 12 according to a sensing signal of the sensor unit 13.

In this case, the control unit 14 receives the sensing signal according to the heating water level from the sensor unit 13 to drive the heater unit 12 to heat the water. And, the control unit 14 receives the sensing signal according to the washing water level from the sensor unit 13 to stop operating the water supply unit 11 to stop supplying the water.

Moreover, the control unit 14 receives the sensing signal according to the temperature of the water from the sensor unit 13 to stop driving the heater unit 12 to stop heating the water.

A method of controlling a hot water washing of a washing machine according to the present invention is explained in the following.

Referring to FIG. 2 and FIG. 3, first of all, a user selects a hot water washing function from various functions of a washing machine (S11).

The user or the control unit 14 of the washing machine sets up a hot water washing condition including a water level, a water temperature, and the like according to a kind or amount of a laundry (S12).

Once the hot water washing condition is set up, the control unit 14 controls the water supply unit 11 to supply the water to the washing tub according to the setup hot water washing condition.

The water supply unit 11 then turns on a water supply valve according to the control signal of the control unit 14 to supply the water to the washing tub (S13).

Subsequently, the sensor unit 13 senses whether the water level of the water supplied from the water supply unit 11 is the heating water level for heating the water to transfer the sensing signal for the heating water level to the control unit 14 (S14).

In this case, the heating water level is determined as a water level under which the heater unit 12 is completely submerged and is preferably about 20~30% of the washing water level.

The setup of the heating water level may vary according to a size of the washing tub, the amount of the laundry, and the like.

Once the water level of the water reaches the heating water level, the control unit 14 receives the sensing signal of the heating water level from the sensor unit 13 to actuate the heater unit 12 (S15).

The heater unit 12 then heats the water according to the control signal of the control unit 14.

Yet, if the water level of the water fails to reach the setup heating water level the control unit 14 keeps the water supply unit 11 supplying the water.

Subsequently, the sensor unit 13 senses whether the water reaches the setup washing water level to transfer the sensing signal of the washing water level to the control unit 14. (S16).

The control unit 14 then keeps the water supply unit 11 supplying the water if the water level of the water fails to reach the setup washing water level or turns off the water supply valve to stop supplying the water if the water level of the water reaches the setup washing water level (S17).

The sensor unit 13 senses whether the temperature of the water reaches the setup washing temperature to transfer the sensing signal of the washing temperature to the control unit 14 (S18).

And, the control unit 14 keeps driving the heater 12 to heat the water if the temperature of the water fails to reach the setup washing temperature or stops driving the heater unit 12 if the temperature of the water reaches the setup washing temperature (S19).

The control unit 14 executes the hot water washing using the hot water heated at the setup washing temperature (S20).

Finally, the control unit 14 stops operating or stands by for a next operation if the hot water washing is completed.

Accordingly, the present invention initiates the heating of the water before completion of the water supply, thereby enabling to reduce the hot water washing time.

Moreover, the present invention is applicable to various kinds of washing machines, and more particularly, to a drum type washing machine for excellent results.

Besides, the present invention reduces the hot water washing time, thereby enabling to reduce the overall washing time to provide the user with time efficiency as well as to reduce electricity charges.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A method of supplying wash water to a washing machine including a water supply device, a heater, a sensor and a controller, the method comprising:

setting a washing condition;

supplying water to the washing machine according to the set washing condition;

determining whether a water level in the washing machine is at a heating water level;

heating the water in the washing machine if the water level is at the heating water level;

determining whether the water level in the washing machine is at a washing water level associated with the set washing condition;

when the water level is at the washing water level, determining whether a water temperature of the water in the washing machine is at a heating temperature associated with the set washing condition; and after the temperature of the water in the washing machine is at the heating temperature, turning off the heater, and then initiating a wash cycle associated with the set washing condition, wherein heating the water in the washing machine comprises turning on the heater as soon as the heater is completely submerged in the water supplied to the washing machine, and continuing to supply water to the washing machine after the water level is at the heating water level while heating the water.

2. The method of claim 1, wherein continuing to supply water to the washing machine comprises supplying water to the washing machine until the water level is at the washing water level while the heater heats the water in the washing machine.

3. The method of claim 1, wherein the washing water level is greater than the heating water level.

4. The method of claim 3, wherein the heating water level is between 20% and 30% of the washing water level.

5. The method of claim 1, wherein the washing condition is a hot water washing condition that includes a hot water level and a hot water temperature associated with a hot water wash cycle.

6. The method of claim 1, wherein the washing machine is a drum type washing machine having an opening in a front vertical surface thereof through which laundry items are inserted into the drum, and a door that opens and closes the opening.

* * * * *